United States Patent [19]

Francis

[11] Patent Number: 4,636,155

[45] Date of Patent: Jan. 13, 1987

[54] HYDRAULIC SEAL HAVING U-SHAPED GASKET AND A PLURALITY OF PLASTICALLY DEFORMABLE POSTS

[75] Inventor: David W. Francis, Canfield, Ohio

[73] Assignee: Commercial Shearing, Inc., Youngstown, Ohio

[21] Appl. No.: 626,297

[22] Filed: Jun. 29, 1984

[51] Int. Cl.[4] ..... F01C 19/08; F04C 15/00

[52] U.S. Cl. ..... 418/132; 277/DIG. 6; 277/180; 277/188 A

[58] Field of Search ..... 418/132, 152, 135; 277/180, 188 A, DIG. 6

[56] References Cited

U.S. PATENT DOCUMENTS

| | | | |
|---|---|---|---|
| 3,142,260 | 7/1964 | Oliver | 418/132 |
| 3,270,680 | 9/1966 | Rich | 418/132 |
| 3,348,492 | 10/1967 | Olson et al. | 418/131 |
| 3,371,615 | 3/1968 | Pettyjohn et al. | 418/132 |
| 3,482,524 | 12/1969 | Marietta | 418/132 |
| 3,643,968 | 2/1972 | Horvath | 277/180 X |
| 3,748,063 | 7/1973 | Putnam | 418/132 |
| 3,890,068 | 6/1975 | Davidson | 418/135 X |
| 3,961,872 | 6/1976 | Müller et al. | 418/132 |
| 4,029,446 | 6/1977 | Mayer et al. | 418/132 |
| 4,242,066 | 12/1980 | Hodgson | 418/132 |
| 4,309,158 | 1/1982 | Grabow et al. | 418/132 |
| 4,358,260 | 11/1982 | Joyner | 418/132 |
| 4,465,444 | 8/1984 | Dworak et al. | 418/132 |
| 4,470,776 | 9/1984 | Kostek et al. | 418/132 X |

*Primary Examiner*—Carlton R. Croyle
*Assistant Examiner*—Paul F. Neils
*Attorney, Agent, or Firm*—Buell, Ziesenheim, Beck & Alstadt

[57] ABSTRACT

A hydraulic fluid seal, a pressure plate and gear pump are provided in which two spaced adjacent surfaces are sealed, one surface having a groove opening toward the other surface, a sealing member adapted to fit in said groove and a plastically deformable interference member in the sealing member having a section such that it will plastically deform before the seal surface of the sealing member.

7 Claims, 6 Drawing Figures

Fig. 1.
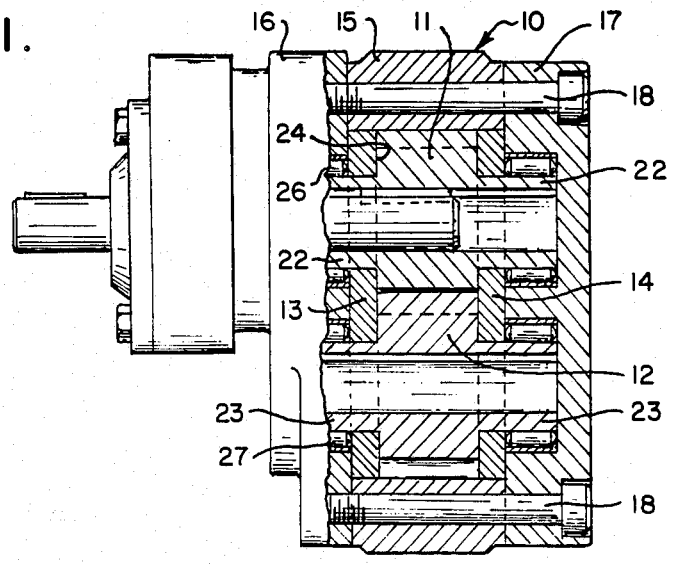
Fig. 4.
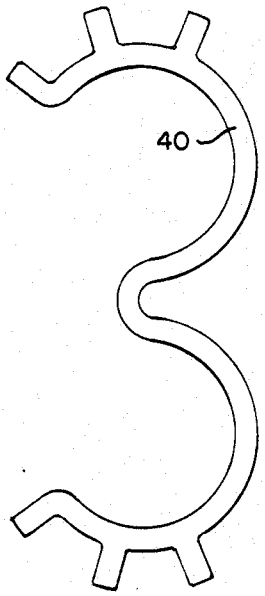
Fig. 2.
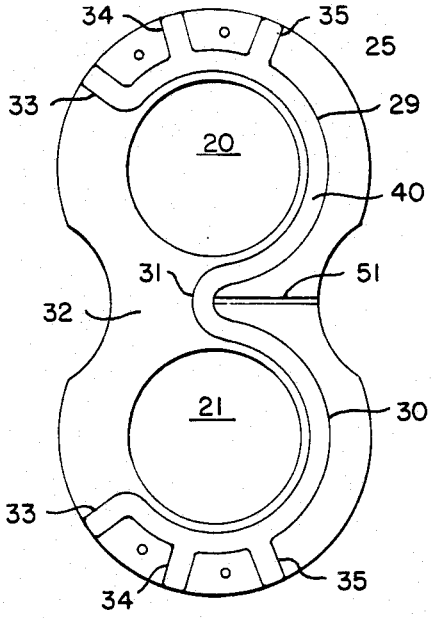
Fig. 5.
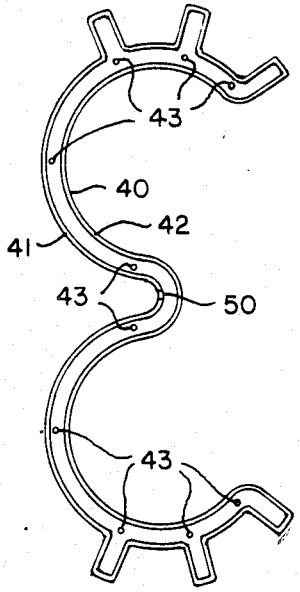
Fig. 3.
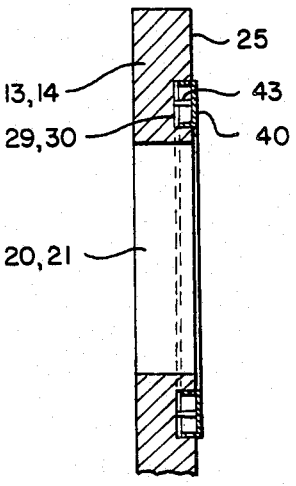
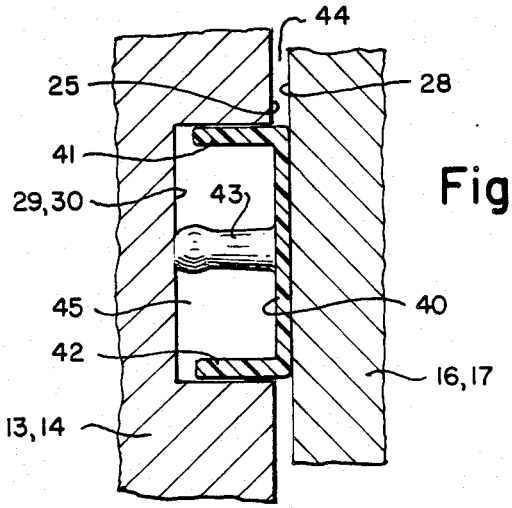
Fig. 6.

HYDRAULIC SEAL HAVING U-SHAPED GASKET AND A PLURALITY OF PLASTICALLY DEFORMABLE POSTS

This invention relates to hydraulic seals and particularly to a plastically deformable non-extrudable seal member having controlled loading characteristics.

The problem of sealing two adjacent surfaces against passage of fluid under pressure has been a problem since hydraulic power became available as a source of usable energy. As metals and their forming techniques have improved, along with more efficient power sources, the demand for higher usable hydraulic pressure has increased. This has, in turn, resulted in a demand for better and better seals.

The hydraulic gear pump and motor are prime examples of the above-mentioned trend. They have been used for many years to transmit power hydraulically from one point to another and reconvert it to mechanical energy. As the pressure requirements for pumps and motors has increased over the years so also have the problems associated with wear and leakage, particularly around the gear ends, at the thrust plates. One of the major problems associated with such thrust plates has been the provision of sufficient sealing pressure between the thrust plate and the gear ends without providing excessive pressure and without extrusion or other destruction or loss of the seal.

There are basically two types of hydraulic seals in general use in the industry today. They are generally known as elastomeric seals and laminar seals. The elastomeric seal is by far the most popular seal in use in the hydraulic industry at the present time. It works by having an elastomeric or spring material create the initial sealing action by being elastically deformed between two opposing surfaces and then relying on pressure of fluid to reinforce the sealing action by further loading the seal into position. Laminar seals rely on close clearances between parts for reducing leakage to a minimum. Laminar seals are normally expensive, compared with elastomeric seals, because of the tight tolerances involved and always involve a certain degree of leakage.

Typical of the seals in use today are those illustrated in Hodgson U.S. Pat. No. 4,242,066; Grabow et al. U.S. Pat. No. 4,309,158; Joyner U.S. Pat. No. 4,358,260; Mayer U.S. Pat. No. 4,029,446; Muller et al. U.S. Pat. No. 3,961,872; Putnam U.S. Pat. No. 3,748,063; Marietta U.S. Pat. No. 3,482,524; Rich U.S. Pat. No. 3,270,680; and Oliver U.S. Pat. No. 3,142,260. The foregoing patents all relate to elastomeric, e.g., Hodgson U.S. Pat. No. 4,242,066, or combination elastomeric and laminar type seals, e.g., Oliver U.S. Pat. No. 3,142,260. These seals are complex and expensive and have limits on the pressures with which they can be used.

I have invented a new form of seal usable between two parts to be sealed which involve a third type of sealing effect, namely, plastic deformation. The seal of this invention creates the initial sealing action by plastic deformation against opposing surfaces to be sealed and may be a zero leakage seal depending upon the elastic deformation characteristics of the plastically deformable seal, however, this is a separate sealing action and is not associated with the primary sealing action of this invention.

Since one of the primary uses for a seal of this type lies in sealing rotary pump and motor thrust plates, the invention will be particularly described in that environment, although it may be used in any similar system, in which a groove is provided in one surface to carry a seal which contacts another surface opposite the groove in said one surface and the groove to provide a seal between the two surfaces. Thrust plate seals are designed in a combination of concave and convex curves with one or more auxiliary legs used to accomplish balancing of the thrust plate with the gear under pressure in the pump or motor. Such plates usually have an extrusion gap of up to 0.010 inches and is therefore subject to seal extrusion, which is a serious problem. In addition, such seals are subject to rapidly pulsating pressure which causes premature failure to elastomeric material due to hysteresis. Such seals also are subject to wear caused by movement of the thrust plate during the pump cycle. Thrust plate seals must also have limited seal load against the plate to avoid high friction which reduces the pump efficiency at lower pressures. Finally, the seal must work over a temperature range of −65° F. to 250° F. and at pressures from 0 psi to 5000 psi.

I provide a hydraulic pressure fluid seal for sealing two adjacent surfaces, one surface having a groove opening toward the other surface comprising a sealing member adapted to fit within said groove and a plastically deformable interference member in the sealing member having a section such that it will plastically deform before the sealing surfaces of the sealing member. Preferably, the sealing member is of U-shaped cross section smaller than the groove and the groove and gap between the surfaces to be sealed and the interference member is a plurality of spaced pins between the legs of the U-shaped member and having a length such that when the surfaces are assembled there is an interference between the seal member and pins causing the pins to deform plastically. The entire seal member and pins are preferably made of a plastically deformable material whose yield point is great enough to resist extrusion into the gap between the surfaces, but low enough to yield in the portion that interferes, namely, the pins. Preferably, the seal and pins are made of reinforced plastic such as glass filled nylon or similar plastically deformable material.

In the foregoing general description I have set out certain objects of this invention. Other objects, purposes and advantages of this invention will be apparent from a consideration of the following description of the accompanying drawings in which:

FIG. 1 is a partial section through a gear pump showing a thrust plate and seal in position;

FIG. 2 is a plan view of a thrust plate and seal of this invention;

FIG. 3 is a section on the line III—III of FIG. 2;

FIG. 4 is a top plan view of the seal of FIG. 2;

FIG. 5 is a bottom plan view of the seal of FIG. 2; and

FIG. 6 is a section through the two adjacent surfaces being sealed as on line III—III.

Referring to the drawings I have illustrated a rotary gear pump housing 10 having a pair of meshing gear impellers 11 and 12 between a pair of end thrust plates 13 and 14 with a central casing member 15 enclosing the outer periphery of the impellers and plates. The thrust plates 13 and 14 and casing member 15 are enclosed between a pair of end bells 16 and 17 held together by bolts 18 extending through the end bells and central casing member to hold them in tightly sealed relation around the impellers. The end thrust plates 13 and 14 are identical and will be described as thrust plate 13 hereafter. The plate 13 is generally in the form of a figure eight having a pair of openings 20 and 21 through which the stub shafts 22 and 23 of impellers 11 and 12 extend. The front face of plate 13 is provided with a flat surface 24 fitting closely against adjacent impeller or gear ends. The rear face of plate 13 is a flat surface 25 facing the end of the bearings 26 and 27 which carry stub shafts 22 and 23 of the impellers. The shell of the bearing and the inner wall of end bells 16 and 17 are flush and form a facing surface 28 spaced slightly from the surface 25. Face 25 of the thrust plate 13 is provided with semi-circular grooves 29 and 30 partially surrounding each opening 20 and 21, and spaced radially uniformly away from each said opening. The grooves 29 and 30 are connected together at one end by a generally radial groove 31 across the neck 32 of the thrust plate. Spaced radial grooves 33, 34, 35 extend outwardly radially from grooves 29 and 30. A generally U-shaped plastic seal 40 having the configuration of all of the grooves combined is fitted in the grooves with the open side down and the legs 41 and 42 of the seal spaced closely to the sides of the grooves. Spaced plastic pins 43 integral with the seal 40 extend downwardly from the interior of the base of the seal between legs 41 and 42 and are of such length that they cause the seal member 40 to project out of the grooves a distance greater than the gap 44 between adjacent surface 25 of the thrust plate and adjacent surface 28 of the bearing shell and end bells. As a result, when the pump is assembled and bolts 18 are tightened, the pins 43 are compressed and plastically deformed as shown in FIG. 6.

As can be seen from the drawings, the combined depth of the sealing grooves 29 through 35 and the gap 44 is less than the seal 40 and pins 43 length. When the seal 40 is placed in the grooves 29 through 35, there is an interference between the height of the seal and the combined depth of groove and gap distance and as a result, the pins will yield to permit assembly of the parts. The seal 40 is made of plastically deformable material whose yield point is great enough to prevent extrusion into gap 44, but low enough to yield in the portion which interferes, namely, pins or posts 43.

The seal 40 is preferably formed of reinforced plastic material such as glass filled nylon or similar material. The pins or posts 43 are made in a cross section which is small compared to the area to be sealed to insure that they yield and not some other area of the seal which is not intended to yield. I have found, moreover, that the load required to cause the portion of the seal which interferes to yield is substantially independent of the amount of interference, i.e. approximately the same load is required to cause the seal to yield 0.010 inch as that requried to yield 0.002 inch. Once yielding has started, proportional additional force is not required to yield the post or pin further. This means that the tolerance on the parts establishing the interference can be greater than on a comparable elastomeric member loading the seal in position.

In the foregoing example of this invention the seal has been made the element that yields, however, it is evident to one skilled in the art that the cover and/or the groove bottom could also be made to yield.

Preferably, the seal member or gasket is sufficiently loose fitting that fluid pressure in area 45 behind the seal will enter one side of the groove and pass under the seal forcing it in tight contact with the opposite side of the groove and urging the seal into tight contact with the opposite surface 28.

This effect may be enhanced by providing a notch 50 in one edge of seal 40 communicating with groove 51 in neck 32 of the end plate.

I have illustrated and described certain preferred practices and embodiments of this invention in the foregoing specification, however, it will be understood that this invention may be otherwise embodied within the scope of the following claims.

I claim:

1. A hydraulic pressure fluid seal for sealing two adjacent surfaces, one of which surfaces has a groove opening toward the other surfaces, comprising a plastically deformable nonelastic sealing member adapted to fit within said groove and a plurality of spaced nonelastic plastically deformable interference members integrally with the sealing member and extending beyond the sealing member in the direction of the groove depth and each interference member having a section such that it will plastically deform before any of the sealing surfaces of the sealing member are engaged between the other sealing surface and the bottom of the groove.

2. A hydraulic pressure fluid seal as claimed in claim 1 wherein the sealing member is of U-shaped cross section adapted to fit in said groove and the interference members are a plurality of integral posts depending from the seal between the legs of the U-shaped member and having a length such that when the surfaces are assembled said posts are plastically deformed lengthwise.

3. A hydraulic pressure fluid seal as claimed in claim 1 or 2 wherein the seal and interference members are made of reinforced nylon.

4. A pressure plate for corresponding ends of a pair of cooperating gears in a rotary gear pump or motor comprising a metal body in the general form of a pair of joined rings arranged as a FIG. 8, having a front face adapted to abut the gear ends and a rear face spaced from and generally parallel to the front face, a pair of openings through the rings to receive gear shafts, a pair of at least half annular grooves in the rear face spaced from and surrounding each of said openings at least on one side, a groove in the rear face connecting said annular grooves at their closest points, at least one groove in the rear face extending radially from each at least half annular groove to the periphery of the body generally opposite the groove connecting the annular grooves defining at least two substantially identical areas on opposite sides of the body, a generally U-shaped plastically deformable nonelastomer gasket having the contour of the combined grooves on the rear face of the body and fitting into said grooves with the opening of the U-shaped gasket opening downwardly in the groove and, plastically deformable nonelastic means integral with the gasket within the U-shaped gasket extending out of said gasket and acting on said gasket normally to urge it partially out of said grooves into sealing contact with the case.

5. A pressure plate as claimed in claim 4 wherein the plastically deformable means are a plurality of posts integral with the gasket depending between the legs of the U-shaped gasket and spaced apart along the gasket length.

6. In a rotary gear pump or motor having a case, a pair of meshing rotary gears in said case, said gears having axial stub shafts journaled in said case, the improvement comprising a unitary thrust plate for the corresponding ends of the pair of rotary gears adapted to lie between the case and the ends of the gears, said thrust plate being of a metal softer than the gears and having a front face adapted to abut the gear ends and a rear face abutting the case, a pair of spaced openings extending through said thrust plate to receive the gear stub shafts, a pair of connected at least half annular grooves in the rear face spaced from and surrounding each of said openings at least on one side, a groove in the rear face connecting said annular grooves at their closest points, at least one groove in the rear face extending radially from each said annular groove to the periphery of the body generally opposite the groove connecting the at least half annular grooves defining at least two substantially identical areas on opposite sides of the body, a generally U-shaped plastically deformable nonelastomer seal gasket having the contour of the combined grooves on the rear face of the body and fitting sealingly into said grooves with the opening of the U-shaped gasket opening downwardly in the groove and at least one integral nonelastic plastically deformed means within said U-shaped gasket extending out of said gasket and urging said gasket partially out of said grooves into sealing contact with the case.

7. In a rotary gear pump or motor as claimed in claim 6 wherein the plastically deformed means are a plurality of posts integral with the gasket depending between the legs of the U-shaped gasket and spaced apart along the gasket length.

* * * * *